US006974046B2

(12) United States Patent
Shenkar

(10) Patent No.: US 6,974,046 B2
(45) Date of Patent: Dec. 13, 2005

(54) TAMPER EVIDENT CLOSURE WITH INTEGRATED VENTING AND METHOD OF MANUFACTURING

(75) Inventor: Emanuel Shenkar, Worth, IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 61 days.

(21) Appl. No.: 10/076,722

(22) Filed: Feb. 14, 2002

(65) Prior Publication Data

US 2003/0150833 A1 Aug. 14, 2003

(51) Int. Cl.[7] ..... B65D 41/34
(52) U.S. Cl. ..... 215/252; 215/258
(58) Field of Search ..... 215/252, 270, 215/258, 274, 276, 350; 53/471

(56) References Cited

U.S. PATENT DOCUMENTS 4,470,513 A 9/1984 Ostrowsky
4,473,163 A * 9/1984 Geiger ..... 215/250
4,478,343 A * 10/1984 Ostrowsky ..... 215/252
4,657,153 A * 4/1987 Hayes ..... 215/252
4,679,696 A * 7/1987 Bonnenfant et al. ..... 215/252
4,694,969 A * 9/1987 Granat ..... 215/252
4,694,970 A * 9/1987 Hayes ..... 215/252
4,705,183 A * 11/1987 Moloney ..... 215/276
4,782,968 A * 11/1988 Hayes ..... 215/276
4,801,031 A * 1/1989 Barriac ..... 215/252
4,813,561 A * 3/1989 Ochs ..... 215/252
4,852,753 A * 8/1989 Ochs ..... 215/271
4,880,127 A * 11/1989 Doi ..... 215/252
4,978,016 A * 12/1990 Hayes ..... 215/252
4,981,230 A * 1/1991 Marshall et al. ..... 215/252
4,989,740 A * 2/1991 Vercillo ..... 215/252
4,993,572 A * 2/1991 Ochs ..... 215/260
5,007,545 A * 4/1991 Imbery, Jr. ..... 215/14
5,009,324 A * 4/1991 Ochs ..... 215/276
5,027,964 A * 7/1991 Banich, Sr. ..... 215/252
5,031,787 A * 7/1991 Ochs ..... 215/276
5,058,755 A * 10/1991 Hayes ..... 215/252
5,062,538 A * 11/1991 Ochs ..... 215/260
5,078,290 A * 1/1992 Ochs ..... 215/276

(Continued)

*Primary Examiner*—Nathan J. Newhouse
*Assistant Examiner*—James N. Smalley
(74) *Attorney, Agent, or Firm*—Knoble Yoshida & Dunleavy, LLC

(57) ABSTRACT

A method of manufacturing a vented tamper evident closure of the J-hook type to a container involves a closure of the type including a base, a downwardly depending sidewall portion and a tamper evident band. The tamper evident band is frangibly connected to the sidewall portion and includes a main band portion and a J-hook retention member that includes a plurality of retaining elements and a corresponding plurality of flexible web elements. Advantageously, the retention member is originally molded in a first position wherein it is positioned substantially beneath and in alignment with the main band portion of the tamper evident band. This molding position creates substantial manufacturing advantages. When the closure is installed onto the container, the retention member is circumferentially compressed and folds inwardly as it is moved to a second, engaged position wherein it is bent upwardly and inwardly to engage the container. The substantial circumferential compression of the retention member is enabled by the provision of the flexible web elements. In addition, ventilation openings are preferably defined within the flexible web elements. The ventilation openings provide a dual benefit in that they further promote efficient moldability of the closure and that they permit the entire container assembly, including the closure, to be washed after packaging to remove any food material that may be left after filling permit the closure.

20 Claims, 4 Drawing Sheets

U.S. PATENT DOCUMENTS 5,258,191 A * 11/1993 Hayes ..... 426/107
5,341,949 A * 8/1994 Hayes ..... 215/253
5,346,082 A * 9/1994 Ochs et al. ..... 215/252
5,400,913 A * 3/1995 Kelly ..... 215/252
5,443,853 A * 8/1995 Hayes ..... 426/107
5,462,184 A * 10/1995 Ingram et al. ..... 215/252
5,570,798 A * 11/1996 Hayashida et al. ..... 215/252
5,660,290 A * 8/1997 Hayes ..... 215/252
5,685,443 A * 11/1997 Taber et al. ..... 215/252
5,727,705 A 3/1998 Kelly
5,755,347 A * 5/1998 Ingram ..... 215/252
5,775,527 A * 7/1998 Bosl et al. ..... 215/252
5,839,592 A * 11/1998 Hayes ..... 215/230
5,884,790 A * 3/1999 Seidita ..... 215/330
5,893,474 A * 4/1999 Herrmann et al. ..... 215/252
5,967,351 A * 10/1999 Ekkert ..... 215/252
6,056,136 A * 5/2000 Taber et al. ..... 215/252
6,085,921 A * 7/2000 Brown ..... 215/252
6,109,464 A * 8/2000 Takano ..... 215/252
6,116,442 A * 9/2000 Higgins ..... 215/252
6,119,883 A * 9/2000 Hock et al. ..... 215/252
6,152,316 A * 11/2000 Niese ..... 215/252
6,220,466 B1 * 4/2001 Hayes et al. ..... 215/276
6,253,939 B1 * 7/2001 Wan et al. ..... 215/252
6,253,940 B1 * 7/2001 Graham et al. ..... 215/252
6,276,543 B1 * 8/2001 German et al. ..... 215/252
6,325,227 B1 * 12/2001 Ekkert ..... 215/252
6,328,175 B2 * 12/2001 Champagnon et al. ..... 215/252
6,405,886 B1 * 6/2002 Gearhart et al. ..... 215/252
6,464,093 B1 * 10/2002 Takano ..... 215/252
6,491,175 B1 * 12/2002 Taha ..... 215/252
6,659,297 B2 * 12/2003 Gregory et al. ..... 215/252
6,662,958 B2 * 12/2003 German et al. ..... 215/252
6,673,298 B2 * 1/2004 Krueger ..... 264/295
6,766,916 B2 * 7/2004 Ma ..... 215/252
2002/0062626 A1 * 5/2002 Gregory ..... 53/471
2002/0066713 A1 * 6/2002 Ma ..... 215/252
2003/0127419 A1 * 7/2003 Shenkar et al. ..... 215/256

* cited by examiner

TAMPER EVIDENT CLOSURE WITH INTEGRATED VENTING AND METHOD OF MANUFACTURING

BACKGROUND OF THE INVENTION

1. Field of the Invention

This invention relates generally to the field of packaging technology, and more specifically to tamper evident closures for containers.

2. Description of the Related Technology

Various beverages, foods, medicines and the like are delivered to the public in bottles or other containers that are provided with resealable closures. Such closures provide a benefit to the consumer in that the containers can be tightly sealed and resealed after opening, which prolongs the shelf life of the product and maintains freshness. Although resealable containers provide benefits to consumers, by their nature they permit unauthorized and sometimes undetectable tampering with the product. Accordingly, many modern consumer products are packaged using tamper evident closures, which are designed to make it apparent to a consumer that a container has been opened.

Many conventional tamper evident closures utilize what is commonly known as a tamper evident band, which is designed to be retained by the container and to rupture or become separated from the consumer removable portion of the closure during opening. Typically, the container itself will include an annular ring or other retention structure for engaging the tamper evident band. The tamper evident band and the mating retention structure of the container are usually designed so that the tamper evident band will slip over the retention structure without damage during the initial application of the closure onto the container at the packaging plant, but that subsequent removal of the tamper evident band from the container will be difficult.

One type of tamper evident band that is in commercial use includes a first portion that is frangibly connected to the consumer removable portion of the closure and a second retention portion, commonly known as a J-hook, that is molded so as to angle radially inwardly and upwardly from a lower portion of the tamper evident band in order to engage retention structure on the container. During initial application of the closure, the retention portion will slip over the retention structure because of the inward and upward angling, but once it slips over the retention structure it will lock against the lower side of the retention structure, making it difficult to remove the tamper evident band from the container. Examples of such closures are disclosed in U.S. Pat. Nos. 6,085,921; 4,470,513; and 5,400,913. Some J-hook designs include ventilation openings for providing ventilation to the space between the closure and the finish portion of the container.

J-hook type closures can unfortunately be problematic to manufacture because the characteristic upward and inward angling of the retention portion necessitates what is known as an undercut in the tooling that is used during the injection molding process. The presence of an extensive undercut makes a part both difficult to mold and difficult to eject from the mold. These problems are preventing the J-hook type closure from reaching its full commercial potential within the packaging industry.

A need exists for an improved J-hook type tamper evident closure having integrated venting and a method of making such a closure that obviates the present manufacturing obstacles that are discussed above.

SUMMARY OF THE INVENTION

Accordingly, it is an object of the invention to provide an improved J-hook type tamper evident closure having integrated venting and a method of making such a closure that obviates the present manufacturing obstacles that are discussed above.

In order to achieve the above and other objects of the invention, a tamper evident closure that is constructed according to a first aspect of the invention includes a body portion having a base and a downwardly depending sidewall portion; and a tamper evident band frangibly connected to the sidewall portion, the tamper evident band including a main band portion, and a J-hook retention member that includes a plurality of retaining elements, at least some of the retaining elements being constructed and arranged to engage a container to which the closure may be mounted in order to retain the tamper evident band on the container when the body portion is removed from the container; and a plurality of flexible web elements, the flexible web elements being sufficiently flexible to render the J-hook retention member circumferentially compressible from a first molded position wherein the retention member is positioned substantially beneath and in alignment with the main band portion of the tamper evident band to a second engaged position wherein the retention member is bent upwardly and inwardly to engage the container for retention purposes; whereby said closure may be manufactured in an efficacious molding position while still providing effective tamper evident packaging assurance.

According to a second aspect of the invention, a method of applying a tamper evident closure of the J-hook type includes steps of providing a container having an opening; providing a closure of the type including a base, a downwardly depending sidewall portion and a tamper evident band frangibly connected to the sidewall portion that includes a main band portion and a J-hook retention member that includes a plurality of retaining elements and a plurality of flexible web elements, the retention member being oriented in a first molded position wherein it is positioned substantially beneath and in alignment with the main band portion of said tamper evident band; and installing the closure onto the container so that the retention member is circumferentially compressed and is moved to a second engaged position wherein said retention member is bent upwardly and inwardly to engage the container for retention purposes.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
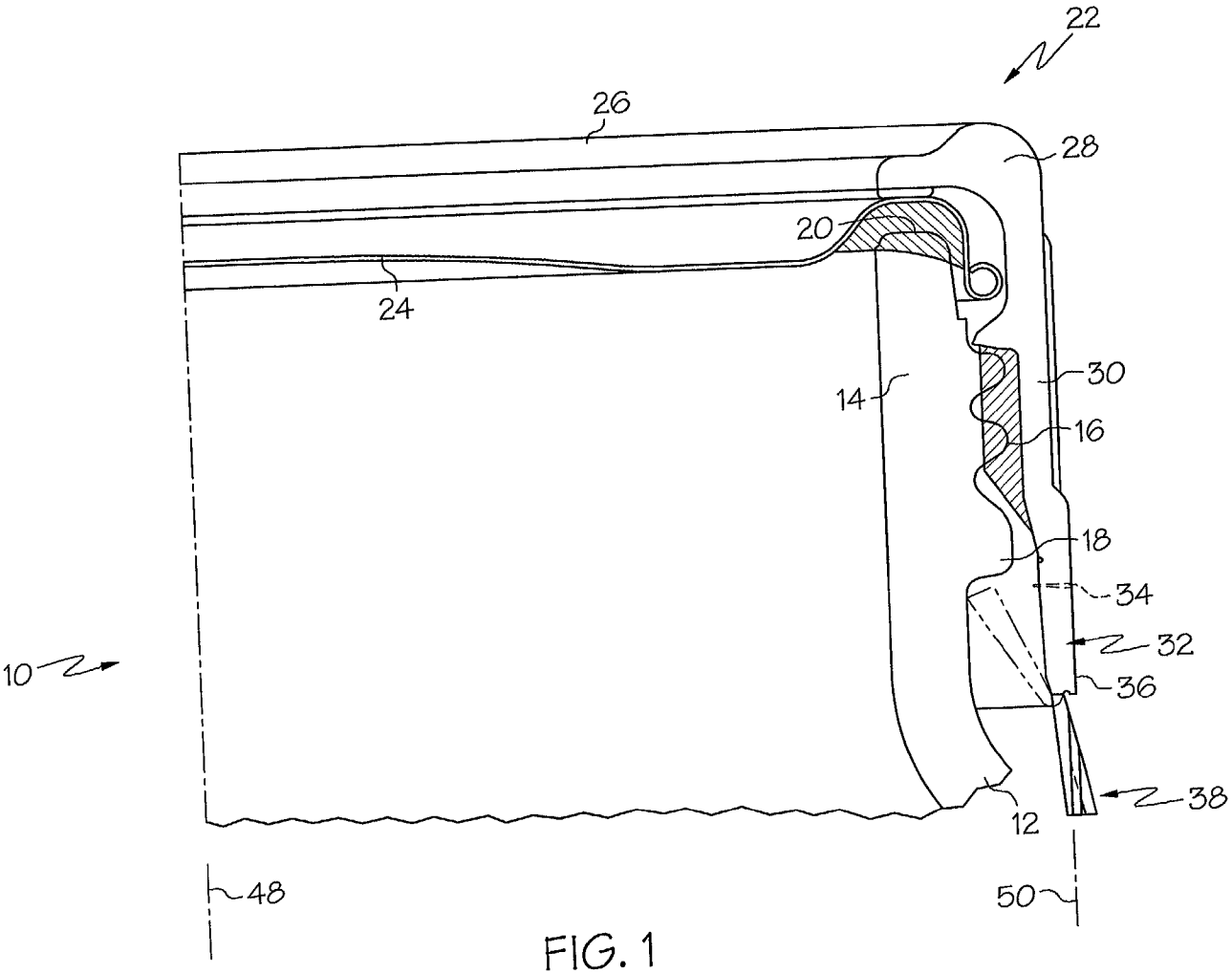
FIG. 1 is a diagrammatical depiction of a container assembly that is constructed according to a preferred embodiment of the invention.

Referring now to the drawings, wherein like reference numerals designate corresponding structure throughout the views, and referring in particular to FIG. 1, a container assembly 10 that is constructed according to a preferred embodiment of the invention includes a container 12 that, as conventional, includes a sidewall 14 having external threading 16 and retention structure that is embodied as an annular external projection 18. Container 12 further has an upper rim 20 defining an opening to the container 12. Container assembly 10 further includes a closure 22 which, in illustrated embodiment, is of the type of a composite closure including a sealing disc 24 that is sealed to the upper rim 20 of the container 12 by a vacuum within the container 12. As is conventional, sealing disc 24 is provided with a gasket material, such as plastisol, to enhance the seal with the upper rim 20 of the container 12.

As may further be seen in FIG. 1, closure 22 includes a closure shell 26 which includes a base portion 28 and a downwardly depending sidewall portion 30 which, in the preferred embodiment, is generally cylindrical in shape and has internal threading that is shaped and sized to mate with the external threading 16 on container 12. Closure 22 further includes a tamper evident band 32 that is frangibly connected to the sidewall portion 30, and that includes a main band portion 36 and a J-hook retention member 38 that includes a plurality of retaining elements 40. In the preferred embodiment, all of the retaining elements 40 are constructed and arranged to engage the annular projection 18 of the container 12 in order to retain the tamper evident band 32 on the container 12 when the rest of the closure 22 is removed from the container 12. Retaining elements 40 are in the preferred embodiment tapered so as to decrease in their circumferential dimension from a first, upper end where they are unitary with the main band portion 36 and are positioned so closely to the adjacent retaining elements 40 as to present a nearly unbroken circumferential surface to a second, distal end 42, best shown in FIG. 2, wherein each of the retaining elements 40 taper into a point.

Although in the preferred embodiment closure 22 is constructed as a composite type closure, it should be understood that the invention has equal applicability for use with closures that are not of the composite type. In particular, the construction of the J-hook retention member 38 and the method of manufacturing a closure that includes such a retention member has wide applicability to all types of plastic molded tamper evident closures, including closures for soft drink containers and the like.

According to one particularly advantageous feature of the invention, retention member 38 is further provided with a plurality of flexible web elements 44, each of which is positioned between two adjacent retaining elements 40. As may be seen in FIG. 2, each of the flexible web elements 44 is inversely tapered with respect to the retaining elements 40, and is molded so as to be unitary with each of the adjacent retaining elements 40. Preferably, each of the flexible web elements 44 is sufficiently flexible to render the J-hook retention member 38 circumferentially compressible from a first molded position, shown in solid lines in FIG. 1, where the retention member 38 is positioned substantially beneath and in alignment with the main band portion 36 of the tamper evident band 32 to a second engaged position, shown in broken lines in FIG. 1, wherein the-retention member 38 is bent upwardly and inwardly to engage the annular projection 18 of the container 12 for retention purposes. As used in this context, the phrase circumferentially compressible is defined as meaning that the retention member 38 can be circumferentially dimensionally reduced without substantially adversely affecting the orientation of the retaining elements 40 with respect to each other. Preferably, the first molded position is characterized by the retention member 38 being positioned so that a longitudinal axis 50 of one of the retaining elements 40 is no more than 20 degrees divergent from a longitudinal axis 48 of the downwardly depending sidewall portion of the closure, and more preferably no more than 10 degrees divergent from a longitudinal axis of the downwardly depending sidewall portion of said closure. Accordingly, a mold mechanism that has no substantial undercut may be utilized. As a result, the closure 22 may be manufactured in a preferable molding position while still providing effective tamper evident packaging assurance.

Figure 2:
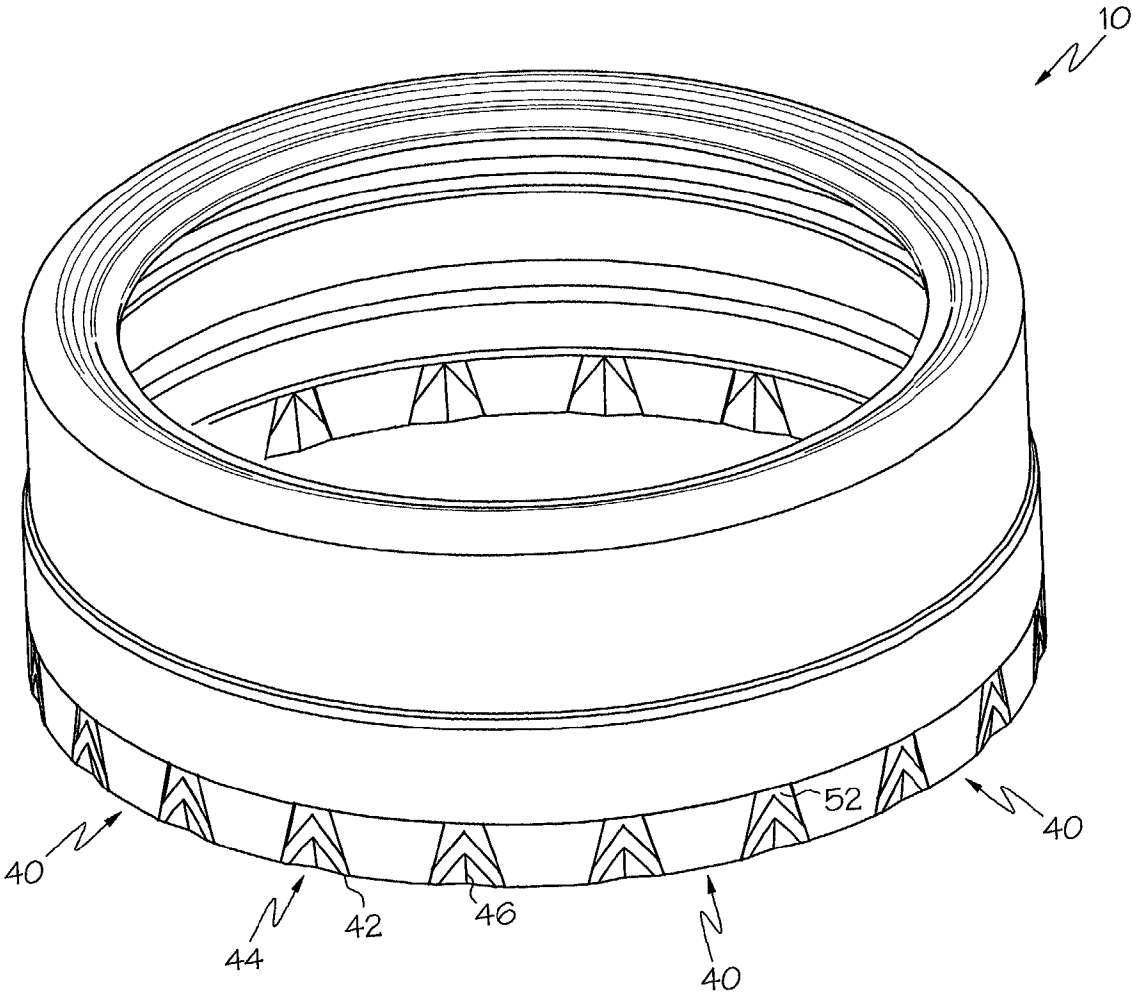
FIG. 2 is a perspective view of one component of the container assembly that is shown in FIG. 1.

As may be seen in FIG. 2, each of the flexible web elements 44 is preferably shaped so as to have a predetermined crease line 46 about which the web elements 44 will begin to fold as the J-hook retention member 38 is circumferentially compressed. The predetermined crease line 46 is positioned radially inwardly from the nearest retaining element 40, whereby the flexible web element 44 will be caused to fold radially inwardly as the J-hook retention member 38 is circumferentially compressed.

Preferably, the flexible web elements 44 are sufficiently flexible to render the J-hook retention member 38 circumferentially reducible in dimension by at least 10 percent, and more preferably by at least 20 percent.

According to another advantageous aspect of the invention, each of the flexible web elements 44 is shaped so as to define a ventilation or drain opening 52, which in the preferred embodiment is positioned in an upper portion of each of the web elements 44. More specifically, in the preferred embodiment each of the web elements 44 are shaped so as to define, together with the lower extreme portions of the retaining elements 40, a band of relatively constant vertical dimension extending around the periphery of the retaining member 38. As a result of this, a generally triangular or V-shaped void is defined by an upper surface of each of the flexible web elements 44 together with the side surfaces of the adjacent retaining elements 40 in order to form the ventilation opening 52. The presence of a ventilation opening 52 in this location serves two different beneficial purposes. First, it permits the entire container assembly, including the closure, to be washed after packaging to remove any food material that may be left after filling. In addition, the absence of plastic material in the area of the ventilation opening 52 further improves the moldability of the closure 22, especially in terms of ejectability from the mold.

Figure 3:
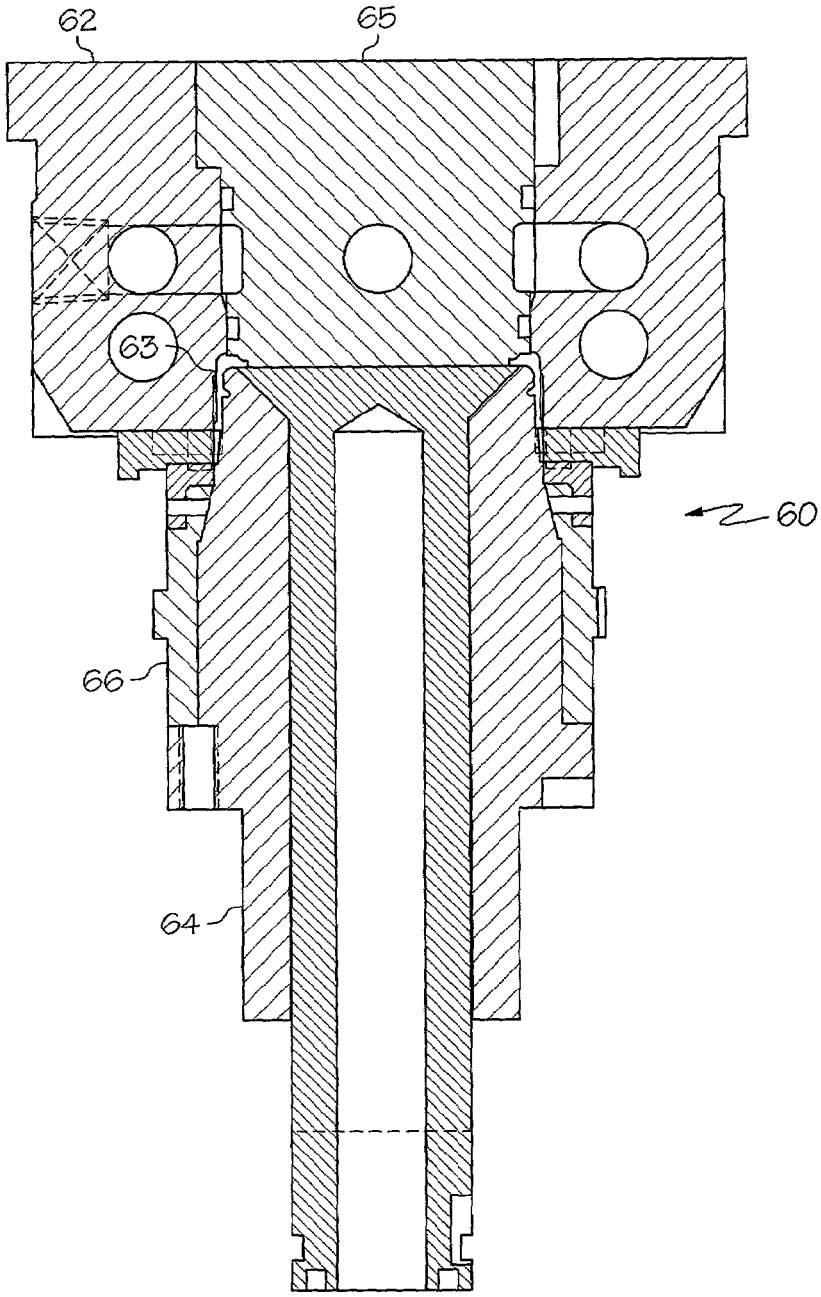
FIG. 3 is a cross-sectional view of a mold assembly that is used in a preferred method according to the invention.
Figure 4:
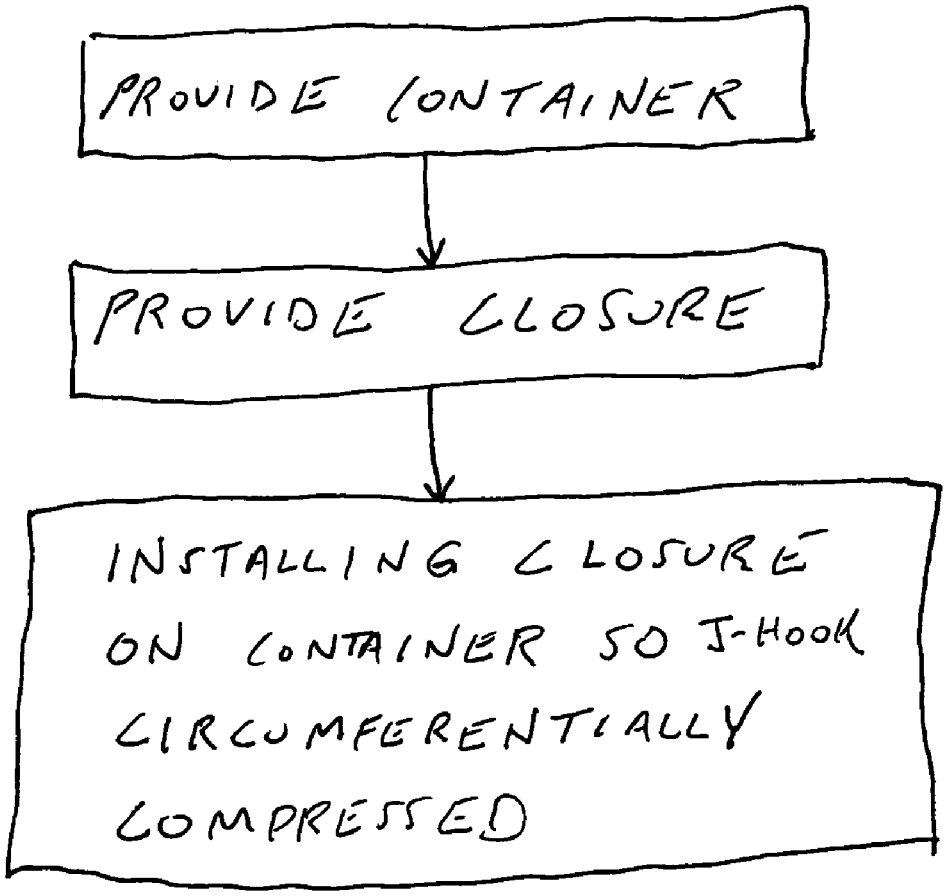
FIG. 4 is a diagrammatical depiction of a method as practiced according to the preferred embodiment of the invention.

FIG. 3 is a cross-sectional depiction of a mold assembly 60 according to a preferred embodiment of the invention that is used to fabricate the closure shell portion 26 of the closure 22 shown in FIG. 2. As may be seen in the FIG. 3, mold assembly 60 includes a mold cavity 62 and a mold core 64. A cavity insert 65 is insertable into the mold cavity 62 and together with the mold core 64 and the sidewall of the mold cavity 62 defines the mold volume 63 that corresponds to the desired molded shape of the closure shell portion 26, including the tamper evident band 32 described above. A stripper mechanism 66 is provided to remove the molded product from the mold at the conclusion of the injection molding cycle.

According to the preferred method of the invention, the closure shell portion 26 will be so molded, and a sealing disk 24 will be preinserted into the closure shell portion 26, typically, by a source supplier to the packaging facility. At the packaging facility, the container 12 will be filled with the desired product, and the preassembled closure assembly 22 will then be applied onto the container 12. As this occurs, the retention member 38, which is preferably pre-folded so as to assume the positioned shown in broken lines in FIG. 1, will be applied onto the container assembly so as to assume the positioned that is depicted in FIG. 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A tamper evident closure, comprising:

a body portion comprising a base and a downwardly depending sidewall portion; and a tamper evident band frangibly connected to said sidewall portion, said tamper evident band comprising:

a main band portion;

a J-hook retention member that is oriented in a first molded position that is substantially beneath and in alignment with said main band portion of said tamper evident band, said J-hook retention member extending continuously about an entire circumference of said tamper evident band;

wherein said J-hook retention member comprises a plurality of flexible web elements, wherein at least one of said flexible web elements has a ventilation opening and a predetermined crease line defined therein;

wherein said J-hook retention member further comprises a plurality of retaining elements, at least some of said retaining elements being constructed and arranged to engage a container to which said closure may be mounted in order to retain said tamper evident band on the container when said body portion is removed from the container; and a plurality of flexible web elements, and said flexible web elements being sufficiently flexible to render said J-hook retention member circumferentially compressible from said first molded position and a second engaged position wherein said retention member is bent upwardly and inwardly to engage the container for retention purposes;

wherein at least one of said flexible web elements is shaped so as to have a predetermined crease line about which said web element will begin to fold as said J-hook retention member is circumferentially compressed; and wherein said flexible web element is shaped so that said predetermined crease line is positioned radially inwardly from the nearest retaining element, whereby said flexible web element will be caused to fold radially inwardly as said J-hook retention member is circumferentially compressed.

2. A tamper evident closure according to claim 1, wherein a plurality of said flexible web elements have a ventilation opening defined therein.

3. A tamper evident closure according to claim 1, wherein said ventilation opening is defined in an upper portion of said flexible web element that is proximate to said main band portion of said J-hook retention member.

4. A tamper evident closure according to claim 1, wherein said flexible web elements are sufficiently flexible to render said J-hook retention member circumferentially dimensionally compressible by at least 10 percent.

5. A tamper evident closure according to claim 4, wherein said flexible web elements are sufficiently flexible to render said J-hook retention member circumferentially dimensionally compressible by at least 20 percent.

6. A tamper evident closure according to claim 1, wherein said first molded position is characterized by said retention member being positioned so that a longitudinal axis of one of said retaining elements is no more than 20 degrees divergent from a longitudinal axis of said downwardly depending sidewall portion of said closure.

7. A tamper evident closure according to claim 6, wherein said first molded position is characterized by said retention member being positioned so that a longitudinal axis of one of said retaining elements is no more than 10 degrees divergent from a longitudinal axis of said downwardly depending sidewall portion of said closure.

8. A tamper evident closure according to claim 1, wherein said ventilation opening is V shaped.

9. A tamper evident closure according to claim 1, wherein each of said flexible web elements are interposed between an adjacent two of said retaining elements.

10. A tamper evident closure according to claim 1, wherein each of said retaining elements is constructed and arranged to engage the container for retention purposes.

11. A tamper evident closure, comprising:

a body portion comprising a base and a downwardly depending sidewall portion; and a tamper evident band frangibly connected to said sidewall portion, said tamper evident band comprising:

a main band portion;

a J-hook retention member that is oriented in a first molded position that is substantially beneath and in alignment with said main band portion of said tamper evident band, said J-hook retention member extending continuously about an entire circumference of said tamper evident band;

wherein said J-hook retention member comprises a plurality of flexible web elements, wherein at least one of said flexible web elements has a ventilation opening and a predetermined crease line defined therein;

wherein said J-hook retention member further comprises a plurality of retaining elements, at least some of said retaining elements being constructed and arranged to engage a container to which said closure may be mounted in order to retain said tamper evident band on the container when said body portion is removed from the container; and a plurality of flexible web elements, and said flexible web elements being sufficiently flexible to render said J-hook retention member circumferentially compressible from said first molded position and a second engaged position wherein said retention member is bent upwardly and inwardly to engage the container for retention purposes; and wherein said retaining elements are tapered in their circumferential dimensions so as to narrow at distal ends thereof that are distal to said body portion of said closure; and wherein said flexible web elements are inversely tapered with respect to said retaining elements.

12. A tamper evident closure according to claim 11, wherein each of said flexible web elements are interposed between an adjacent two of said retaining elements.

13. A tamper evident closure according to claim 11, wherein each of said retaining elements is constructed and arranged to engage the container for retention purposes.

14. A tamper evident closure according to claim 11, wherein a plurality of said flexible web elements have a ventilation opening defined therein.

15. A tamper evident closure according to claim 11, wherein said ventilation opening is defined in an upper portion of said flexible web element that is proximate to said main band portion of said J-hook retention member.

16. A tamper evident closure according to claim 11, wherein said flexible web elements are sufficiently flexible to render said J-hook retention member circumferentially dimensionally compressible by at least 10 percent.

17. A tamper evident closure according to claim 16, wherein said flexible web elements are sufficiently flexible to render said J-hook retention member circumferentially dimensionally compressible by at least 20 percent.

18. A tamper evident closure according to claim 11, wherein said first molded position is characterized by said retention member being positioned so that a longitudinal axis of one of said retaining elements is no more than 20 degrees divergent from a longitudinal axis of said downwardly depending sidewall portion of said closure.

19. A tamper evident closure according to claim 18, wherein said first molded position is characterized by said retention member being positioned so that a longitudinal axis of one of said retaining elements is no more than 10 degrees divergent from a longitudinal axis of said downwardly depending sidewall portion of said closure.

20. A tamper evident closure according to claim 11, wherein said ventilation opening is V shaped.

* * * * *